US005964386A

United States Patent [19]

Cote

[11] Patent Number: 5,964,386

[45] Date of Patent: Oct. 12, 1999

[54] DETACHABLE ACCESSORY HOLDER

[76] Inventor: Lucile M. Cote, 4731 Jubilee Trail, Shingle Springs, Calif. 95682

[21] Appl. No.: 09/089,946

[22] Filed: Jun. 2, 1998

Related U.S. Application Data

[60] Provisional application No. 60/048,829, Jun. 6, 1997.

[51] Int. Cl.[6] ..... A45F 5/00

[52] U.S. Cl. ..... 224/250; 224/666; 224/682; 224/236; 224/901.6

[58] Field of Search ..... 224/250, 901.4, 224/901.6, 652, 654, 655, 666, 681, 682, 683, 684, 235, 236, 237, 436, 437, 563; 150/112, 114, 117, 145; 190/111; D3/225, 290, 326

[56] References Cited

U.S. PATENT DOCUMENTS

| | | | |
|---|---|---|---|
| 668,466 | 2/1901 | Taylor et al. | 224/683 X |
| 2,384,285 | 9/1945 | Deutsch | 224/572 X |
| 3,148,812 | 9/1964 | Hilsinger, Jr. | 224/250 |
| 3,955,609 | 5/1976 | Siegel | 150/117 |
| 4,174,793 | 11/1979 | Wisowaty | 224/683 X |
| 4,796,790 | 1/1989 | Hamilton | 224/250 X |
| 4,966,320 | 10/1990 | DeSantis et al. | 224/901.4 X |
| 4,967,986 | 11/1990 | Schildkraut | 224/250 |
| 5,395,023 | 3/1995 | Naymark et al. | 224/901.6 X |
| 5,458,267 | 10/1995 | Curtis et al. | 224/901.4 X |
| 5,460,308 | 10/1995 | Hahn | 225/250 X |

*Primary Examiner*—Allan N. Shoap
*Assistant Examiner*—Gregory M. Vidovich
*Attorney, Agent, or Firm*—John P. Costello

[57] ABSTRACT

An accessory holder for attaching to a person's belt or clothing, allows for the carrying of a variety of tools and accessories, while the wearer's hands remain free for performing other tasks. This accessory holder allows leashes, power cords, tools, bicycle helmets, and other items, which are too large for pants pockets, to be carried. The accessory holder is comprised of a flexible, folding, nylon body, having a front side and a rear side. The front side is comprised of a clothing fastener for fastening the accessory holder to a belt or clothing. The front side has a pair of light attachment points, which when coupled, fold the front side together. The rear side has a pair of heavy attachment points with a load area located therebetween. An accessory is placed in the load area and the heavy attachment points are coupled, leaving the accessory or a part thereof cradled in the load area for easy carrying. Upon coupling the light and heavy attachment points, the accessory holder folds together and achieves a compact shape on the wearer.

6 Claims, 3 Drawing Sheets

DETACHABLE ACCESSORY HOLDER

CROSS REFERENCE TO RELATED APPLICATIONS

This application claims the benefit of U.S. Provisional Application No. 60/048,829, filed Jun. 6, 1997.

FIELD OF THE INVENTION

This invention pertains generally to a device for holding accessories for purposes of freeing up a person's hands, for other tasks, and, more specifically, to a detachable holder for work and leisure accessories such as dog leashes, bicycle helmets, accessory bags, and power cords.

BACKGROUND

Leisure activities, such as walking, cycling and running remain popular as Americans continue to seek good health and physical enjoyment. Attendant to these activities are a myriad of small accessories. For example, the typical cyclist wears a biking helmet and biking gloves; the typical runner or walker might carry a hat, a dog leash for a pet, or money for emergencies. Often, during the course of the activity, the participant might remove an accessory, such as a bicycle helmet, or else remove a leash from a pet to let it run free. During these times, the participant is left to carry a bulky item, with no place to put it. Clothing pockets are too small to accommodate bulky items such as leashes and helmets, and therefore, standard clothing fails to address this storage problem. Often, during prolonged walks or bike rides, carrying such a bulky accessory can become uncomfortable and awkward.

Additionally, in the work environment, it is often useful to have some means for holding items such as power cords. For example, at a construction site a worker might have to change power tools numerous times. To save having to bend over and pick up a power cord each time, it would be convenient to have an accessory holder which would allow a cord to be held, and therefore, easily accessible to the worker.

Therefore, a need exists for a device which can allow bulky leisure or work accessories to be stored, for purposes of increasing a participant's level of freedom and comfort during leisure and work activities. The present invention accomplishes these ends.

The foregoing discussion reflects the state of the art of which the inventor is aware, and is tendered with a view toward discharging the inventor's acknowledged duty of candor in disclosing information which may be pertinent with regards to the patentability of the present invention. It is respectfully stipulated, however, that the disclosed information does not teach or render obvious, singly or when considered in combination, the inventor's claimed invention.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
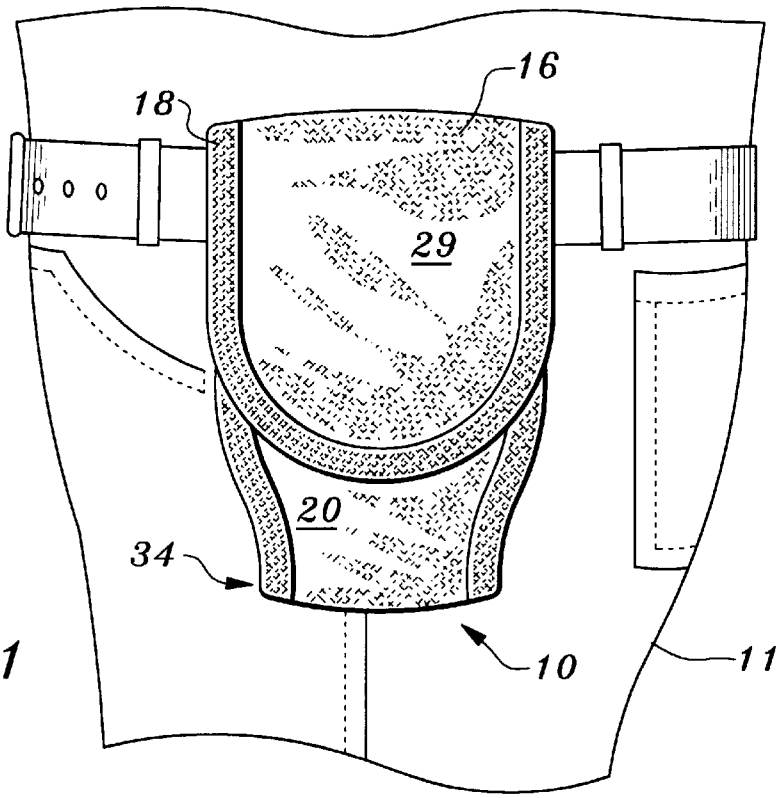
FIG. 1 is a view of the detachable accessory holder which is the present invention, shown coupled to a wearer's belt.
Figure 2:
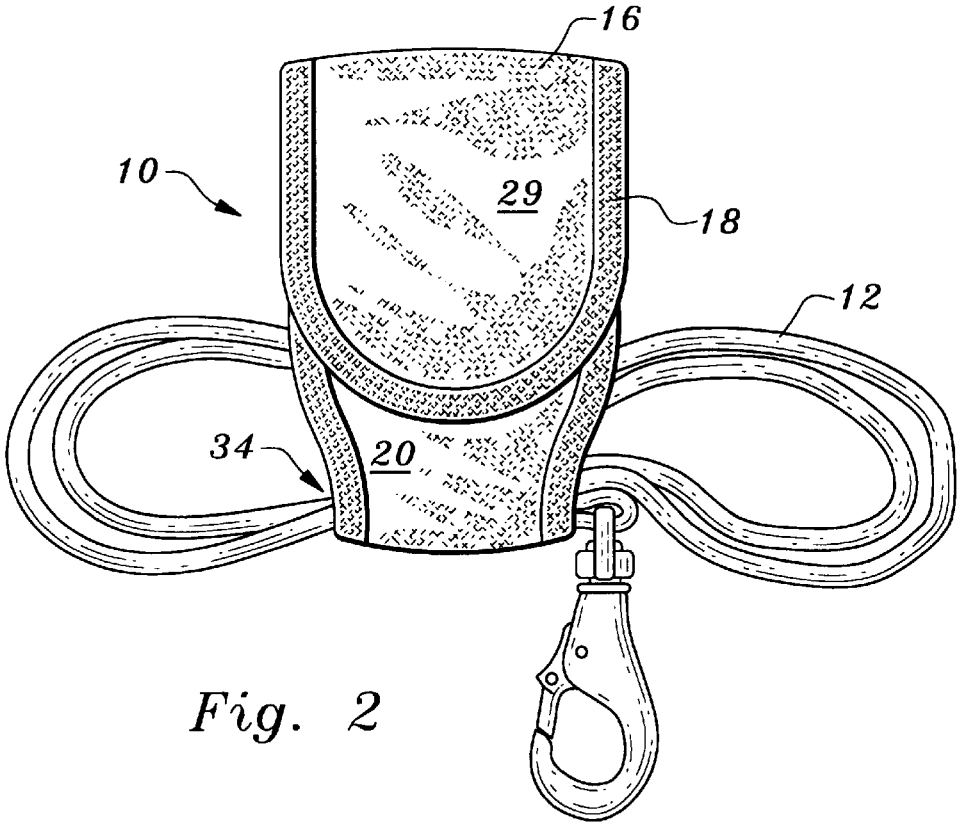
FIG. 2 is a closeup view of the accessory holder which is the present invention shown with a dog leash coupled thereto.
Figure 3:
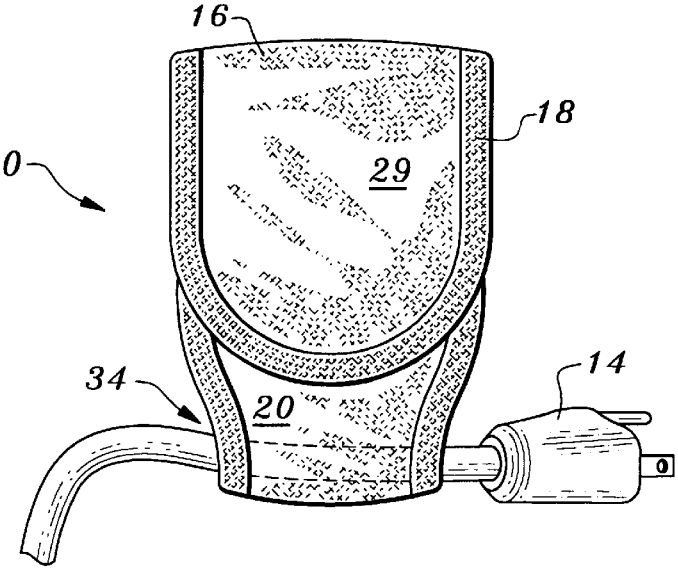
FIG. 3 is a closeup view of the accessory holder which is the present invention shown with a power cord coupled therein.
Figure 4:
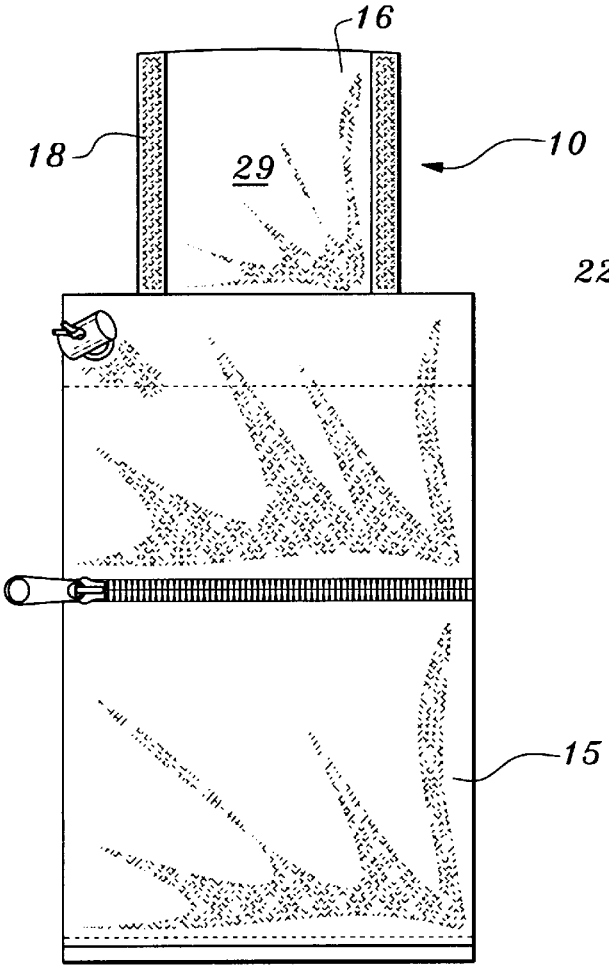
FIG. 4 is a closeup view of the accessory holder which is the present invention shown with an accessory bag coupled thereto.
Figure 5:
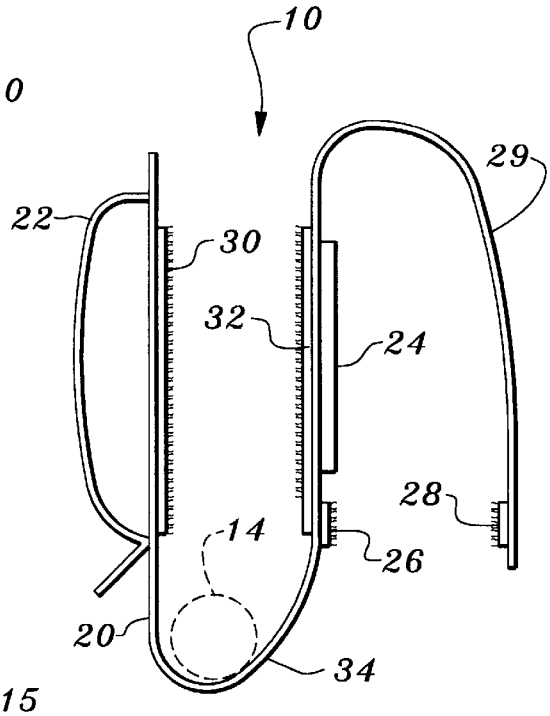
FIG. 5 is a side view of the present invention shown folding around a power cord.
Figure 6:
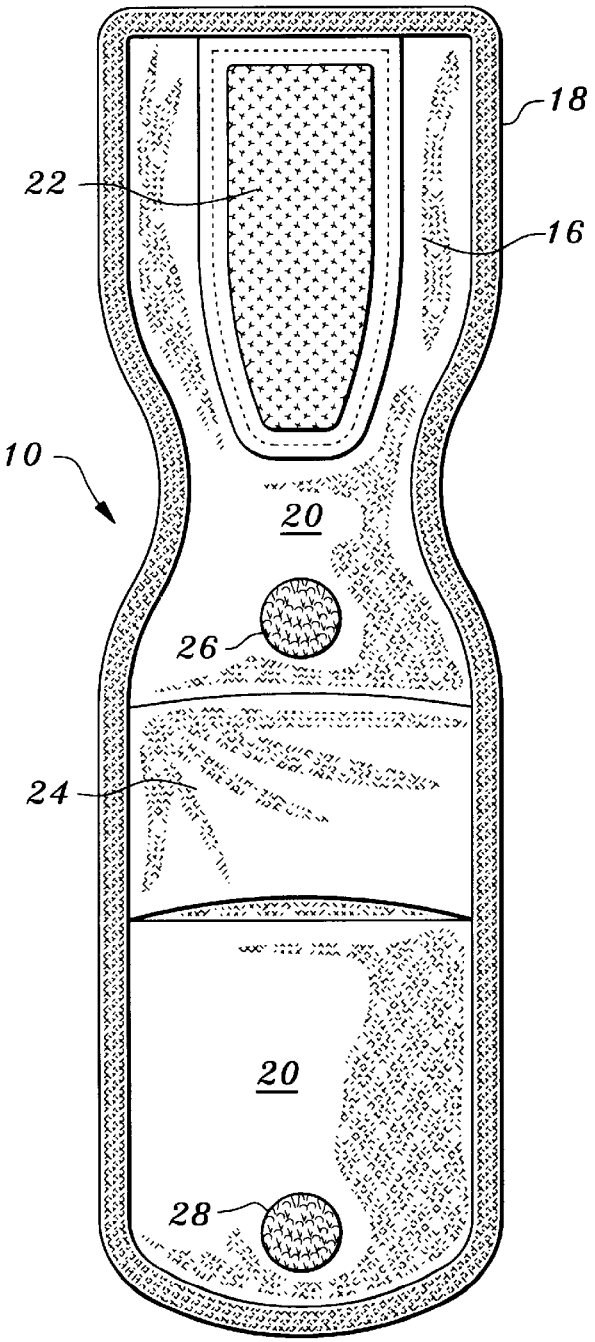
FIG. 6 is a first front view of the accessory holder which is the present invention, shown in a fully opened state.
Figure 7:
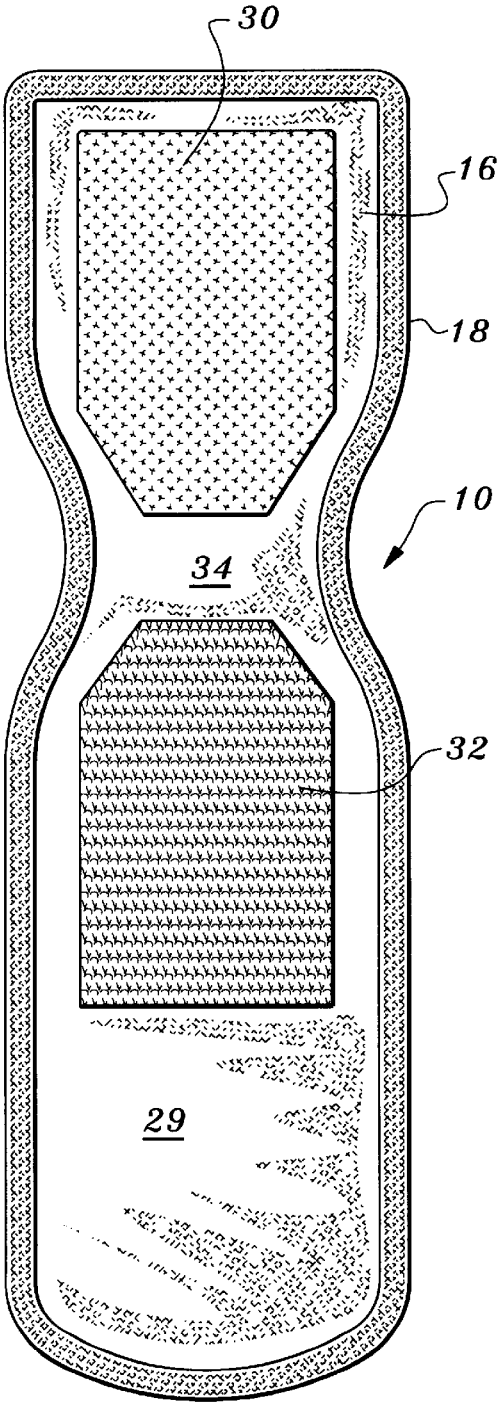
FIG. 7 is a second, rear view of the accessory holder shown in FIG. 6.

Referring more specifically to the drawings, for illustrative purposes, the present invention is embodied in the detachable accessory holder 10 shown generally in FIG. 1 attached to a wearer 11. In FIG. 2 a dog leash 12 is shown as being carried by accessory holder 10, however, other bulky items such as bicycle helmets, gloves, hats, power cords 14, or accessory bags 15 could be similarly carried, as further seen in FIGS. 3 and 4. FIG. 5 shows the operation of accessory holder 10 folding around a power cord 14. FIGS. 6 and 7 show opposite sides of accessory holder 10 in a fully opened state. As shown, accessory holder 10 is comprised of a flexible material body portion 16, such as woven nylon, having a surrounding border 18 for strength and wear resistance. FIG. 6 shows a front side 20 having a clothing fastener 22, a change pocket 24, and light attachment points 26, 28. Light attachment points are preferably comprised by Velcro hook and loop fasteners. Upon closing light attachment points 26, 28 together, change pocket 24 is enclosed by front side 20 and protected from spillage of money or other items. Light attachment points 26, 28 can be readily detached with minimal resistance to allow for quick access to change or other small articles which are contained in pocket 24. Clothing fastener 22 allows the entire accessory holder 10 to be attached and detached from a user's belt or clothing. A clip of the type shown in FIGS. 5 and 6 suffices as a preferred embodiment for clothing fastener 22.

FIG. 7 illustrates the rear side 29 opposite of front side 20 shown in FIG. 6, the accessory holder 10 again shown in a fully opened state. Heavy attachment points 30, 32 are shown, these being preferably comprised of Velcro hook and loop fasteners, however buttons or snaps would be applicable as heavy attachment points as well. The load area 34 located between heavy attachment points 30, 32 serves as a placement point for accessories, such as a dog leash, a power cord, or the strap of a bicycle helmet. Upon closing heavy attachment points 30, 32 together, the accessory, or a component thereof, is enclosed, and can be suspended from accessory holder 10.

Heavy attachment points 30, 32 can accommodate accessories of up to five (5) pounds without accidentally opening and unfurling accessory holder 10. Once an accessory is enclosed in this device, the hands are left free to work or to relax, at will.

FIGS. 1–4 show the accessory holder 10 in its closed, compact, state and holding a variety of different accessories. FIG. 5 shows the accessory holder 10 folding together. FIGS. 6–7 show the accessory holder 10 in its fully opened state. In its closed state, load area 34 is located at a lower most point for purposes of comfortably suspending any one of a plurality of accessories. To close accessory holder 10 from its fully opened state, accessory holder is first positioned on a belt or clothing with clothing fastener 22 . Next, an accessory is positioned in load area 34 and heavy attachment points 30, 32 are coupled together. Finally, light attachment points 26, 28 are coupled, and the accessory holder 10 is now fully closed and ready for walking with an accessory positioned therein.

Accordingly, it will be seen that this invention provides for an accessory holder for work and leisure accessories which allows a user's hands to remain free to perform other tasks or to relax, at will. Finally, although the description above contains many specificities, these should not be construed as limiting the scope of the invention but as merely providing illustrations of some of the presently preferred embodiments of this invention.

I claim:

1. An accessory holder for detachably coupling to a person's clothing, the accessory holder comprising:

a body portion having a front side and a rear side, said front side further comprising a clothing fastener for detachably coupling said accessory holder to a person's clothing, said front side further comprising first and second light attachment points, said first and second light attachment points for folding toward each other and coupling together to enclose a change pocket, said light attachment points providing easy access to articles enclosed in said change pocket, said rear side further comprising first and second heavy attachment points positioned on opposite sides of a load area, said load area for suspending an accessory, said first and second heavy attachment points for folding toward each other and coupling together, said front and rear sides folding upon coupling said light and heavy attachment points together, thereby forming said accessory holder into a compact state and locating said load area at a lowermost point spaced below said heavy attachment points for suspending the accessory below said heavy attachment points which allows the suspended accessory to pass beyond opposing lateral edges of said load area.

2. The accessory holder of claim 1, wherein said load area is a load bearing surface for bearing loads weighing up to five pounds.

3. The accessory holder of claim 1, wherein said heavy attachment points and said light attachment points are further comprised of hook and loop fasteners.

4. The accessory holder of claim 1, wherein said body portion is comprised of nylon material.

5. The accessory holder as recited in claim 1, further comprising a border surrounding said body portion to increase strength and wear resistance.

6. The accessory holder of claim 1, wherein said clothing fastener is a clip.

* * * * *